United States Patent [19]

Braginetz

[11] 3,934,338

[45] Jan. 27, 1976

[54] MULTIPLE BLADE SAFETY RAZOR COMBINATION

[75] Inventor: Paul A. Braginetz, Augusta County, Va.

[73] Assignee: Philip Morris Incorporated, New York, N.Y.

[22] Filed: Dec. 11, 1972

[21] Appl. No.: 313,742

[52] U.S. Cl. ..... 30/47; 30/50

[51] Int. Cl.[2] ..... B26B 21/06

[58] Field of Search ..... 30/32, 47, 50, 346.57, 30/346.58, 85, 75; 403/331, 360

[56] References Cited

UNITED STATES PATENTS

| | | | |
|---|---|---|---|
| 693,595 | 2/1901 | Frazier | 403/331 X |
| 1,303,090 | 5/1919 | McCray | 403/331 X |
| 1,425,463 | 8/1922 | Fischer | 30/50 X |
| 2,319,980 | 5/1943 | Des Jardins | 30/50 X |
| 3,388,831 | 6/1968 | Hansom | 30/346.58 X |
| 3,724,070 | 4/1973 | Dorion | 30/47 |
| 3,771,223 | 11/1973 | Dawidowicz | 30/50 X |
| 3,777,396 | 12/1973 | Simohetti | 30/50 X |
| 3,810,305 | 5/1974 | Perry | 30/32 |
| 3,842,499 | 10/1974 | Dorion | 30/50 |

FOREIGN PATENTS OR APPLICATIONS

| | | | |
|---|---|---|---|
| 24,738 | 11/1950 | Finland | 30/50 |

*Primary Examiner*—Al Lawrence Smith
*Assistant Examiner*—Gary L. Smith
*Attorney, Agent, or Firm*—Watson Leavenworth Kelton & Taggart

[57] ABSTRACT

A multiple blade razor of the double edge type in which the blades are permanently fixed in a razor head cartridge there being two pairs of small blades with the blades at each edge arranged in a superposed but spaced relation the cartridge being adapted for releasably mounting on a handle to enable replacement of a used cartridge, the razor head including a bridge or base member and a generally U-shaped cap member with intervening pairs of blades and a spacer member between the upper and lower pairs of blades, the several members embodying particular elements cooperating to simplify assembling operations and insure accurate relations in the final assembly of the head.

9 Claims, 5 Drawing Figures

MULTIPLE BLADE SAFETY RAZOR COMBINATION

The invention concerns a multiple blade safety razor which in general is of a double edge type. The prior art discloses many adaptations of the idea of a multiple blade razor both of the single edge and double edge types. As the terms are employed herein by a single edge is meant that the razor is arranged for shaving at only one side even though there may be two or more cutting edges at that side; and consistently therewith by the term double edge it is meant that the razor is adapted for shaving at two opposite sides and there may be a plurality of cutting edges at each side.

The prior art also embodies many and varied examples of what may be regarded as semiautomatic means for changing blades without manually touching the blades and in a few cases are permanently mounted in a head or cartridge and the razor is associated with a supply magazine of a character to enable the replacement of the cartridge without manually touching the cartridge part containing the sharp blade edges. In the case of double edge razors the prior art proposals referred to usually appear to concern the changing of double edge blades per se.

The present invention is characterized in general by an arrangement comprising a razor of the double edge type embodying a permanently assembled razor head cartridge having two pairs of individual blades. Two of the blades are positioned at each side in spaced superposed relation with an intervening spacer. The assembly requires only a single cap member and likewise a single main platform and bridge member. The general arrangement is such as to enable the assembly to be effected in a simple economical manner with the blades accurately and uniformly positioned in the final assembly.

The principles of the invention and the structural features and advantages will be made more apparent by a consideration of a representative embodiment as described hereinafter and disclosed in the accompanying drawings in which.

Figure 1:
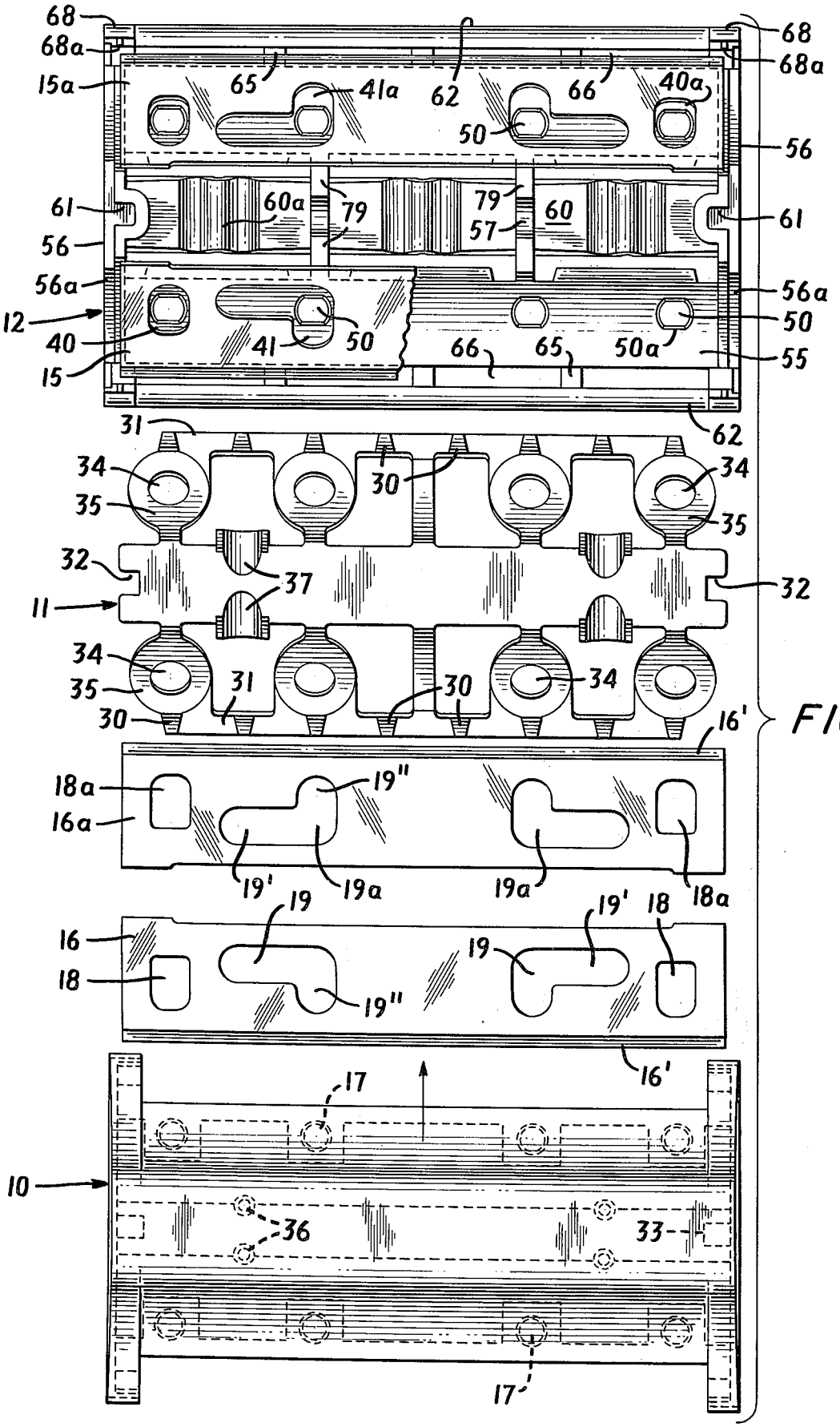
FIG. 1 is a composite figure showing the elements of the razor head cartridge in unassembled condition.

The razor head cartridge comprises a rigid unit adapted to be replaceably mounted on a suitable handle. It embodies three major blade supporting members each shown in top plan view and unassembled in FIG. 1 comprising a cap member 10, a blade spacer member 11 and a main bridge platform member 12. The assembled razor head embodies multiple blades a first pair of blades 15, **15*a* being shown applied to the platform member 12 with one of the blades broken away in part; and a second pair of blades 16, 16a being shown separately in plan in FIG. 1**.

The members may be composed of different materials as desired but it is convenient and economically practical to make the members 10 and 12 of molded plastic and the spacer member 11 of metal.

The relation of the members and the structural details of the respective members may be best understood in connection with the manner of assembly of the razor. The cap member 10 embodies studs or posts 17 arranged in a row at four at each side of the midportion of the cap member symmetrically arranged. In assembling the cartridge the cap member may conveniently be reserved in position from that shown in FIGS. 3 and 4 with the posts 17 accordingly extending upwardly. Over each row of posts there is applied a blade 16 or 16a with the cutting edge 16' arranged outwardly. Each blade 16 has a hole 18 adjacent each end adapted to receive the corresponding post 17. Likewise the blade **16*a* has a hole 18*a* adjacent each end adapted to receive a post 17. The holes 18 and 18*a* are located appropriately to receive the posts 17 and are elongated transversely to permit outward radial movement for final positioning against stops in the cap member 10 as will be described shortly. Blade 16 is also provided with a pair of right angle holes 19 and blade 16a similarly wih holes 19*a*. The holes 19, 19*a* thereby are adapted to receive sabres which have a corresponding right angle shape in cross section. In this respect it is pointed out that as a manufacturing convenience and economy the blades are initially formed as a double strip which is subsequently split along the longitudinal center line and the strip broken transversely between blades. The holes 19, 19*a* corresponding in shape to the sabres provide a means for accurately positioning the blade sections during the breaking operation. The longitudinally elongated portions 19' also are adapted to receive flat sabres useful in further blade manufacturing operations. The transversely elongated portions 19'' are of course adapted to receive the corresponding posts 17**.

The final outward radial position of each blade is determined by stop shoulders precisely located in the base member or cap member against which the cutting edge engages when the blade is drawn outwardly by magnetic means as will be described thereby to position precisely the cutting edge relative to the guard surfaces built into the razor head. In the present construction for the blades 16, 16a the stops are provided by shoulders 20 (FIG. 3) on the inner surface of fingers 21 extending radially from the respective end wall of the cap member 10 at each end thereof. The cap member is recessed at each side under the respective blade as shown at 24 in FIG. 3 to insure that the blade is seated in a stable condition against the flat land 25.

Next the spacer member 11 is applied. The spacer means may vary considerably in construction, the form shown in the present embodiment comprising a skeleton sheet of metal of open grill work having radial fingers 30 connected at their outer ends by a thin strip 31. A notch 32 located at each end of the spacer (FIG. 1) is adapted to engage over a locating lug 33 at the corresponding end of the cap member as shown at the left end in FIG. 4. The spacer has a row of holes 34 at each side positioned to receive the corresponding posts 17 of the cam member 10, the holes being defined by the annular flat rings 35. The thickness of the spacer as measured for example at the annular rings 35 may vary but preferably it is such as to result in a space between the blades 15 and 16 in the range of 0.015 to 0.060 of an inch, a space of 0.020 of an inch being a good example.

Figures 3, 4, 5:
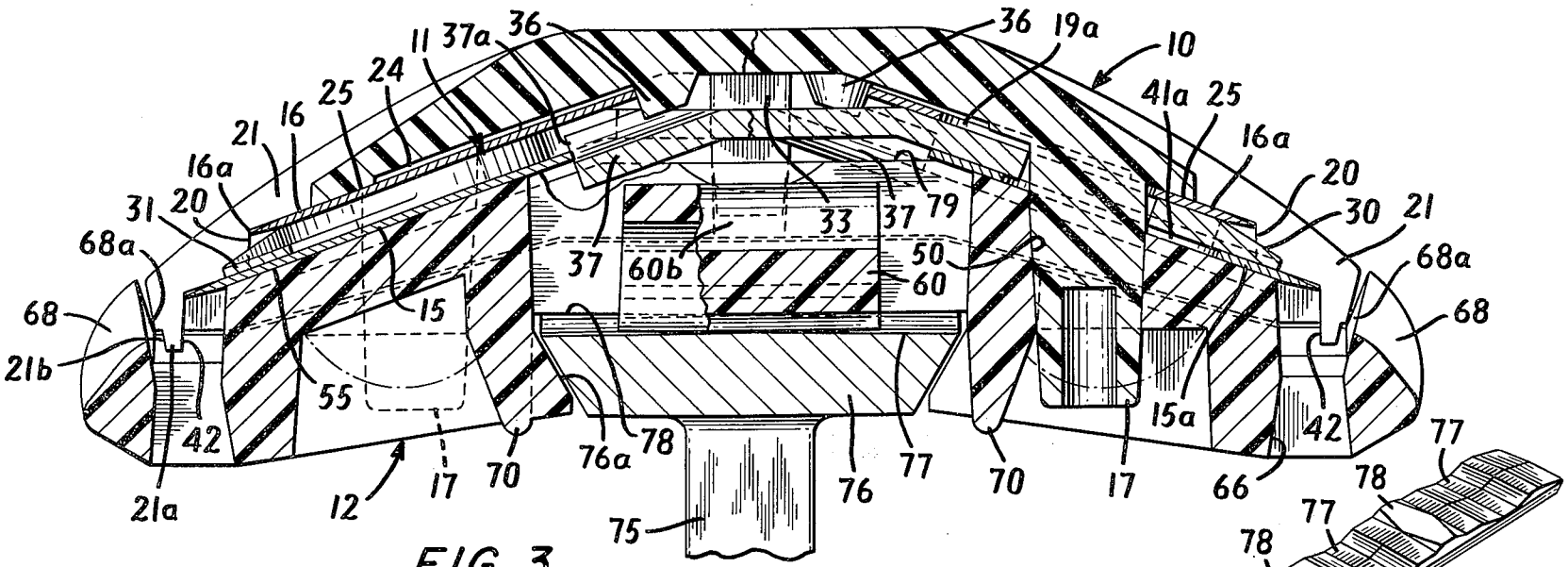
FIG. 3 is an elevational cross sectional view taken on the plane III—III of FIG. 2.
FIG. 4 is an elevational cross sectional view taken longitudinally of the razor head on the plane IV—IV of FIG. 2.
FIG. 5 is a view in perspective of the handle without any razor head cartridge.

Although not necessary it may be convenient in some types of assembling operations to provide temporary limiting stops for the rear edges of the respective blades. In the present case stop lugs 36 extend from the inner surface of cap 10 there being a pair at each side of the center line of cap (FIGS. 1 and 3). Each lug 36 extends into a complemental depression 37 in the spacer 11.

It will be noted from FIG. 3 that in the normal position of the razor, the blades are all arranged so that they extend radially outwardly and downwardly from the midportion of the cap member 10. However, as previously stated, in assembling the razor head cartridge it is convenient to position the cap member 10 top side down, that is reversed from the position shown in FIG. 3. The space between the lugs 36 and the respective blade stops 20 is such that the blade may be freely dropped into the space and the lugs 36 prevent the blade from sliding down any substantial amount. However, in the final clamped position the blades will have been drawn outwardly by magnetic means so that the exact final position will be determined by the stop shoulders 20. Such magnetic means may be maintained in position adjacent the edges of the cap during the assembling operation or brought into position just before the parts are clamped together.

As the next step the two bottom blades **15, 15*a* are applied over the posts 17. These blades may be generally similar to the blades 16, 16*a* but since they are offset radially of the razor head relative to the blades 16, 16*a* the holes for receiving the posts 17, and particularly the end holes 40, 40*a* are located at different positions crosswise of the blades, compared to the holes 18, 18*a* in blades 16, 16*a*. For manufacturing convenience and to receive the middle pair of posts 17 the blades 15, 15*a* preferably are provided with holes 41, 41*a* corresponding in general to holes 19, 19*a* in the blades 16. The blades 15, 15*a* may differ in other respects from the blades 16, 16*a* such as with respect to material or coatings. Similarly to the blades 16, 16*a* the final position of the blades is determined by fixed stops in the razor head which comprise in the present case stop shoulders 42 on the respective fingers 21 of the cap member 10 (FIG. 3). The trough shaped depressed portions 37 in the spacer member 11 each provide a shoulder 37*a* at the rear edge of the blade 15 which serve for initially positioning the blades in the same manner as the lugs 36 serve with respect to the blades 16, the final position of the blades 15 being determined by the magnetic means functioning to draw the blades 15 outwardly against the stops 42. The blades 15 extend radially outward beyond the blades 16** a desired distance which as an example may be about 0.045 of an inch.

As a next step the blade platform member 12 is applied over the posts 17. Holes 50 in the member 12 are provided for the purpose which are flatted at the transverse sides as indicated at **50*a* and elongated on the other diameter the transverse diameter at the flattened sides corresponding closely to the diameter of the posts and providing a surface partially surrounding the posts 17** to aid in heading the pins over onto the corresponding surface of the platform in the final assembly. The elongated dimension provides a permissible tolerance between the several members in the lengthwise direction thereof since that is not a critical relation in the shaving function of the razor.

The platform member 12 is in general of a skeleton form with open spaces as may be seen particularly in FIG. 1. It includes the flat blade support lands 55, end walls 56 (FIG. 2) and a pair of transverse ribs 57. The end walls are recessed downwardly as indicated at **56*a* to receive the end skirt portions 58 of the cap member (FIGS. 1, 2 and 4), the skirts having integral therewith the lugs 33 referred to above. As a result the assembled cartridges have smooth flat ends as indicated in FIG. 4**.

Extending longitudinally of the platform 12 and supported at its ends on end walls 56 of the platform and at intervening points on the transverse ribs 57 is a detent carrying bar 60 having three flexibly mounted pressure pads 60a comprising detent elements adapted to cooperate with recesses in the head of the razor handle as will be described more fully hereinafter.

The platform 12 has at each end an opening in the form of a notch 61 into which extends the elongated lug 33 projecting from the inner surface of the cap member 10 through the notch openings 32 in the spacer 11 to position the spacer 11 both longitudinally and transversely and aid in insuring the proper relation of the three main members. The platform 12 has cast integrally therewith soap or guard bars 62 integral with the end walls of the platform and connected to the blade support lands 55 by short ribs 65 with intervening open spaces 66.

Figure 2:
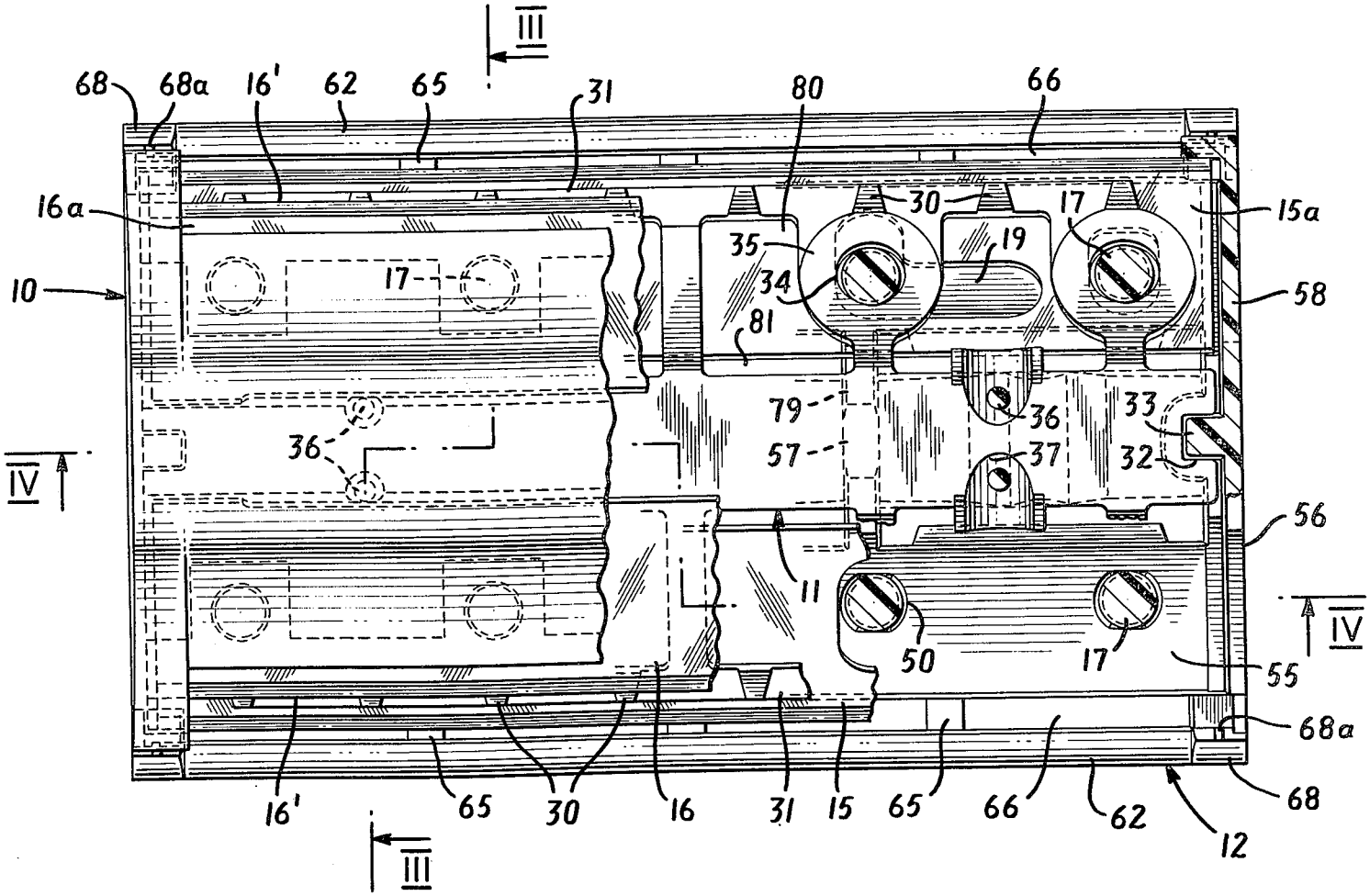
FIG. 2 is a top plan view of the assembled razor head cartridge with various elements broken away in part.

As shown particularly in FIG. 3 and in FIG. 2 the platform member 12 has at each corner a hook portion 68 which has molded therewith an elongated protuberance in the form of a slender wedge shaped sliver **68*a* against which the outer ends of the corresponding finger 21 of the cap member engages. The finger ends are elongated downwardly at 21a and have a notch 21*b* which aids in initially guiding the parts together. Also the elongated parts 21*a* provide a safety margin in extending the stops 42 so that the blades 15 will not jump over the stops in the assembly when the blades are pulled with force up against the stops by the magnets before the pin 17 can be headed over. The four slender protuberances 68*a* being of plastic material and somewhat crushable provide a press fit and nest the cap member to the bridge member and together with the engagement of the lugs 33 in the notches 61** of the platform member insure a no tolerance assembly between the cap and platform members in the transverse direction and parallelism between the soap bars, blade edges and cap member for proper shaving.

After the members are assembled as above described they are rigidly secured together by riveting or other deformation of the ends of the posts 17 by suitable means which may include the application of heat. The flat annular lands 35 on the spacer 11 surrounding the respective posts 17 insures a solid enclosure around the posts between the cap member 10 and the under surface of the platform member 12 and avoids distortions of the cap member and the blades. As heretofore noted prior to the locking together of the members the position of the blades outwardly against their respective limiting shoulders is assured by the appropriate juxtapositioning of magnets.

In accordance with a particularly advantageous means for changing used cartridges for new ones the cartridges are slid into the bottom of a magazine in which the cartridges are arranged in a vertical stack, the cap part of the used cartridge being engaged under the bridge part of the next upper cartridge. To enable free sliding movement and avoid the cap part of the insert engaging in the bottom open grill work each platform member is provided with a pair of spaced runners comprising rib extensions 70 extending the length of the under surface of the platform and projecting downwardly a short distance preferably a minimum of 0.010 of an inch (FIG. 3).

The character of the handle (see FIG. 5 may vary but in general it is of slender light weight design. The handle head embodies means cooperative with the detent platform member 12 including the detent bar 60 whereby the handle and cartridge may be releasably interlocked by a relative movement between the handle and cartridge endwise of the latter. In the present case the means comprises a dovetail connection with a key on one part and a complemental socket in the other part. FIGS. 3 and 4 taken in conjunction with FIG. 5 show such an arrangement. The handle 75 has rigid therewith an elongated plate 76 which comprises the key part of the dovetail connection and the top surface of which has three arc shaped depressions 77 into which normally but releasably engage the detent elements 60*a* on the bar 60 of the platform 12. For convenience in molding the plate 76 may have a slight crown at the center line 76*a* sloping downwardly to the two side edges. The elements 60*a* are formed by loops 60*b* in the bar 60 (FIG. 4) to provide flexibility. The detents provide releasable means for determining the proper relative positioning of the key 76 in the socket 76*a* of the assembled cartridge. Preferably the key 76 has pads 78 which bear on the cross braces 57 at the four points 79 (FIG. 1) and act as stabilizers.

In shaving debris which may collect under the blades 16 and above the blades 15 can move inwardly between the fingers 30 of the spacer member into spaces 80 (FIG. 2) and downwardly through openings 81 in the open grill work around the bar 60 of the platform member 12.

Since various changes may be made in the structural details and relations of the parts shown and described herein and accordingly different embodiments of the invention be made within the principles thereof, it is intended that all matter contained herein shall be interpreted as illustrative and not in a limiting sense.

I claim:

1. In a combination a razor head cartridge embodying a cap member, multiple blades, a blade spacer member, and a main platform member, a first pair of opposed blades being arranged under said cap member each extending radially outwardly from the midportion of the cap member, a second pair of blades similarly arranged with the spacer member positioned between the pairs of blades, the platform member being arranged adjacent the second pair of blades, said cap member having a pair of spaced downwardly projecting lugs positioned at each side of the midportion of the cap member to limit initially the rearward position of the respective said first blade the final radial outward position of the blade being determined by shoulder stop means on the cap member, each said lugs being nested in a depression in the spacer member, each said depression providing a shoulder to limit initially the rearward position of the respective said second blade the final radial position of the blade being determined by a shoulder stop means in the cap member, and a plurality of posts clamping together the said members and blades as a rigid assembly.

2. In a multiple blade razor having a cap member and a platform member with an intervening pair of blades in superposed relation and a spacer member between the blades and locking posts connecting the cap member and platform member and extending through openings in the spacer member and the blades, said spacer member having an annular flat reinforcing ring around each post opening of greater thickness than the adjacent main portions of the sheet, and a finger extending outwardly between the blades from each said ring and merging therewith.

3. In combination a razor head cartridge embodying a main platform member, a cap member and razor blades located between said members, said members being generally rectangular in shape, said platform member having a radially extending hook portion at each corner, and said cap member having a wall at each end closely fitted between the said hook portions at the corresponding end, said hook portions having small protuberances projecting inwardly in an opposed arrangement toward the cap member end wall, said protuberances being of deformable plastic and the corresponding said end wall of the cap member being press fitted between the opposed protuberances.

4. A cartridge in accordance with claim 3 in which each of said cap member end walls has a locating lug extending into a complemental opening in said platform member.

5. In combination a razor head cartridge embodying a cap member, multiple blades, blade spacer means and a main platform member, a first pair of said blades being arranged under said cap member each extending radially outwardly and downwardly from the mid-portion of the cap member with the respective cutting edges at the outer edges of the cap member, a second pair of blades similarly arranged on the platform member, a spacer means positioned between the first pair of blades and the second pair of blades, said cap member having a radially extending finger at each corner, each finger having an inner first shoulder against which the corresponding blade of the first pair engages to determine its position, and an outer second shoulder against which the corresponding blade of the second pair engages to determine its position, said spacer means comprising a single thin sheet extending across the razor head cartridge, and a plurality of posts at each side of the midportion extending from the cap member through the respective blades, spacer sheet and platform member with their ends secured in a platform member thereby firmly and accurately establishing the relations to each other of the said members, the two pairs of the blades and the spacer sheet.

6. A razor head cartridge in accordance with claim 5 in which said spacer means comprises a thin sheet of metal with open grillwork having holes for the posts each hole being surrounded by an annular flat ring of greater thickness than the adjacent main portions of the sheet.

7. A razor head cartridge in accordance with claim 5 in which said cap member is provided at each end with a lug extending through a complemental notch in the corresponding end of said spacer sheet and engaged in a complemental notch in said platform member.

8. In combination a razor head cartridge embodying a cap member, multiple blades, a blade spacer member, and a main platform member, a first pair of opposed blades being arranged under said cap member each extending radially outwardly from the midportion of the cap member, a second pair of blades similarly arranged with the spacer member positioned between the pairs of blades, the platform member being arranged adjacent the second pair of blades, said cap member having a transversely extending skirt portion at each extreme end, a locating lug extending inwardly from each of said skirt portions into a notch in the corresponding end of the spacer and into a notch in the corresponding ends of the platform member, means clamping said members and blades together as a rigid unit, and said cartridge having means for removably mounting it as a self-contained unit on a supporting handle.

9. A razor head cartridge in accordance with claim 8 in which the clamping means comprises a plurality of posts extending from the cap member at each side of its midportion through the spacer and platform members and the corresponding blades.

* * * * *

UNITED STATES PATENT OFFICE

CERTIFICATE OF CORRECTION

PATENT NO. : 3,934,338

DATED : January 27, 1976

INVENTOR(S) : Paul A. Braginetz

It is certified that error appears in the above-identified patent and that said Letters Patent are hereby corrected as shown below:

Col. 1, line 19 after "cases" insert --the blades--

Col. 2, line 7 after row "at" should read --of--

Col. 2, line 10 "reserved" should read --reversed--

Col. 2, line 23 "wih" should read --with--

Col. 3, line 6 after "line of" insert --the--

Col. 4, line 32 "ends" should read --end--

Col. 5, line 7 "(see FIG. 5" should read --(see FIG. 5)--

Signed and Sealed this

*thirteenth* Day of *April 1976*

[SEAL]

*Attest:*

RUTH C. MASON
*Attesting Officer*

C. MARSHALL DANN
*Commissioner of Patents and Trademarks*